US012800236B2

(12) United States Patent
Wada et al.

(10) Patent No.: US 12,800,236 B2
(45) Date of Patent: Nov. 17, 2026

(54) HEAT DISSIPATION SHEET

(71) Applicant: DENKA COMPANY LIMITED, Tokyo (JP)

(72) Inventors: Kosuke Wada, Tamana-gun (JP); Kenji Fukao, Shibukawa (JP); Kazuhiro Ohshima, Shibukawa (JP)

(73) Assignee: DENKA COMPANY LIMITED, Tokyo (JP)

( * ) Notice: Subject to any disclaimer, the term of this patent is extended or adjusted under 35 U.S.C. 154(b) by 260 days.

(21) Appl. No.: 18/706,662

(22) PCT Filed: Nov. 9, 2022

(86) PCT No.: PCT/JP2022/041742
§ 371 (c)(1),
(2) Date: May 1, 2024

(87) PCT Pub. No.: WO2023/085326
PCT Pub. Date: May 19, 2023

(65) Prior Publication Data

US 2026/0160502 A1 Jun. 11, 2026

(30) Foreign Application Priority Data

Nov. 10, 2021 (JP) ..... 2021-183207

(51) Int. Cl.
*F28D 21/00* (2006.01)

(52) U.S. Cl.
CPC ..... *F28D 21/00* (2013.01); *F28D 2021/0029* (2013.01)

(58) Field of Classification Search
CPC ..... F28D 21/00; F28D 2021/0029
See application file for complete search history.

(56) References Cited

U.S. PATENT DOCUMENTS 6,160,029 A * 12/2000 Chaudhary ..... C08L 23/10 521/139
11,523,655 B2 * 12/2022 Bender ..... A43B 13/04
2002/0151609 A1 * 10/2002 Chaudhary ..... C08J 9/14 521/60
2003/0219598 A1 11/2003 Sakurai
2007/0041918 A1 2/2007 Meneghetti et al.
2016/0215178 A1 * 7/2016 Inenaga ..... C09J 123/0815
(Continued)

FOREIGN PATENT DOCUMENTS

CN 101095085 A * 12/2007
JP 2003309235 A * 10/2003
(Continued)

OTHER PUBLICATIONS

Dec. 13, 2022 International Search Report issued in International Patent Application No. PCT/JP2022/041742.
(Continued)

*Primary Examiner* — Nelson J Nieves
(74) *Attorney, Agent, or Firm* — Oliff PLC

(57) ABSTRACT

A heat dissipation sheet of the present invention has a surface hardness of 60 degrees to 95 degrees in terms of an Asker C hardness and a dielectric breakdown voltage of 15 kV/mm or more. According to the present invention, a heat dissipation sheet having an excellent thermal conductivity and insulating property can be provided.

2 Claims, 2 Drawing Sheets

(56) References Cited

U.S. PATENT DOCUMENTS

| | | | | |
|---|---|---|---|---|
| 2018/0192547 | A1* | 7/2018 | Nishio | B32B 27/283 |
| 2019/0176448 | A1 | 6/2019 | Mukohata et al. | |

FOREIGN PATENT DOCUMENTS

| | | | | | |
|---|---|---|---|---|---|
| JP | 2004-134604 | A | | 4/2004 | |
| JP | 2004-200534 | A | | 7/2004 | |
| JP | 2006-257392 | A | | 9/2006 | |
| JP | 2012022833 | A | * | 2/2012 | |
| JP | 2016-155937 | A | | 9/2016 | |
| JP | 2018-203857 | A | | 12/2018 | |
| JP | 2020-138328 | A | | 9/2020 | |
| JP | 2020-164365 | A | | 10/2020 | |
| KR | 20070084308 | A | * | 8/2007 | H10F 19/804 |
| WO | WO-02072691 | A1 | * | 9/2002 | C08L 23/0815 |
| WO | WO-2016137303 | A1 | * | 9/2016 | B60L 50/64 |
| WO | 2016/189850 | A1 | | 12/2016 | |
| WO | 2018/030430 | A1 | | 2/2018 | |
| WO | WO-2021034099 | A1 | * | 2/2021 | C08L 75/06 |

OTHER PUBLICATIONS

Jan. 27, 2025 extended Search Report issued in European Patent Application No. 22892824.8.

* cited by examiner

HEAT DISSIPATION SHEET

TECHNICAL FIELD

The present invention relates to a heat dissipation sheet formed by molding a thermally conductive resin composition containing a boron nitride powder and a resin.

BACKGROUND ART

In heat-generating electronic components such as power devices, transistors, thyristors, and CPUs, how to efficiently dissipate heat generated during use is an important issue. In related art, as a measure for such heat dissipation, it has been common practice to (1) increase a thermal conductivity of an insulating layer of a printed wiring board on which a heat-generating electronic component is mounted and (2) attach a heat-generating electronic component or a printed wiring board on which a heat-generating electronic component is mounted to a heat sink via an electrically insulating thermal interface material. A silicone resin or an epoxy resin filled with a ceramic powder is used as the insulating layer of the printed wiring board and the thermal interface material.

As the ceramic powder, a boron nitride powder, which has characteristics such as a high thermal conductivity, a high insulating property, and a low relative permittivity, has attracted attention. For example, PTL 1 discloses a boron nitride powder formed by aggregating primary particles of boron nitride. The boron nitride powder has a peak A existing in a region of 5 μm or more and less than 30 μm and a peak B existing in a region of 50 μm or more and less than 100 μm in a volume-based particle size distribution.

CITATION LIST

Patent Literature

PTL 1: JP 2020-164365 A

SUMMARY OF INVENTION

Technical Problem

By using the boron nitride powder described in PTL 1, a heat dissipation sheet having an excellent thermal conductivity and insulating property can be obtained. However, along with miniaturization of electronic devices and an increase in amount of heat generated by heat-generating electronic components in recent years, a heat dissipation sheet having a more excellent thermal conductivity and insulating property is required.

Therefore, an object of the present invention is to provide a heat dissipation sheet having an excellent thermal conductivity and insulating property.

Solution to Problem

The present inventors conducted intensive studies to achieve the above object, and were able to achieve the above object by surface-treating the boron nitride powder using a predetermined silicone oil.

The present invention is based on the above findings and includes the following.

[1]A heat dissipation sheet having a surface hardness of 60 degrees to 95 degrees in terms of an Asker C hardness and a dielectric breakdown voltage of 15 kV/mm or more.

[2] The heat dissipation sheet according to the above [1], which has a void area rate of 5.0% or less in a cross section when cut in a thickness direction.

Advantageous Effects of Invention

According to the present invention, a heat dissipation sheet having an excellent thermal conductivity and insulating property can be provided.

DESCRIPTION OF EMBODIMENTS

[Heat Dissipation Sheet]

Figure 1:
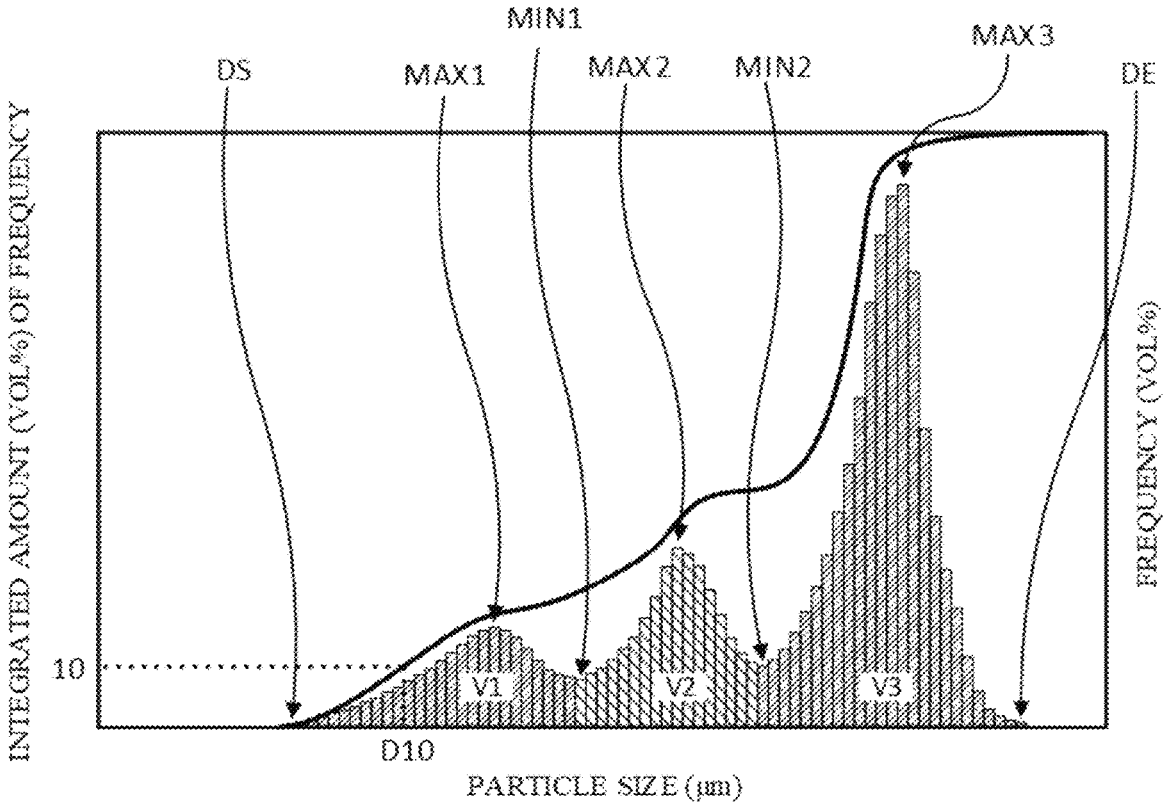
FIG. 1 is a conceptual diagram of a particle size distribution of a boron nitride powder contained in a heat dissipation sheet of the present invention.

A heat dissipation sheet of the present invention has a surface hardness of 60 degrees to 95 degrees in terms of an Asker C hardness and a dielectric breakdown voltage of 15 kV/mm or more. Accordingly, a thermal conductivity and an insulating property of the heat dissipation sheet can be improved.

(Surface Hardness)

The surface hardness of the heat dissipation sheet of the present invention is 60 degrees to 95 degrees in terms of the Asker C hardness. When the surface hardness of the heat dissipation sheet of the present invention is less than 60 degrees, handling of the heat dissipation sheet may be difficult. When the surface hardness of the heat dissipation sheet of the present invention is larger than 95 degrees, the heat dissipation sheet cannot follow an unevenness of a surface of a heat-generating element, and adhesion to the heat-generating element is impaired, resulting in poor thermal conductivity. From such a viewpoint, the surface hardness of the heat dissipation sheet of the present invention is preferably 65 degrees to 90 degrees, and more preferably 75 degrees to 85 degrees in terms of the Asker C hardness. The surface hardness of the heat dissipation sheet can be measured by a spring hardness test in accordance with SRIS0101 at a test temperature of 25° C. using an Asker C type testing machine (trade name: Asker rubber hardness meter C type, manufactured by KOBUNSHI KEIKI CO., LTD.). By performing a surface treatment of a boron nitride powder using a predetermined silicone oil, the heat dissipation sheet becomes flexible, and the surface hardness of the heat dissipation sheet can be set within the above-described range.

(Dielectric Breakdown Voltage)

The dielectric breakdown voltage of the heat dissipation sheet of the present invention is 15 kV/mm or more. When the dielectric breakdown voltage is less than 15 kV/mm, increasingly strict requirements for the insulating property of the heat dissipation sheet may not be met along with miniaturization of electronic devices and an increase in amount of heat generated by heat-generating electronic components in recent years. From such a viewpoint, the dielectric breakdown voltage of the heat dissipation sheet is preferably 20 kV/mm or more, and more preferably 25 kV/mm or more. An upper limit of the range of the dielectric breakdown voltage of the heat dissipation sheet is not particularly limited, and is generally 40 kV/mm. The dielectric breakdown voltage of the heat dissipation sheet can be measured by a method described in Examples to be described later. By performing the surface treatment of the boron nitride powder using the predetermined silicone oil, occurrence of voids at an interface between boron nitride particles and a resin can be prevented, and thereby the dielectric breakdown voltage of the heat dissipation sheet can be set within the above-described range.

(Void Area Rate)

A void area rate in a cross section of the heat dissipation sheet of the present invention when cut in a thickness direction is preferably 5.0% or less. When the void area rate is 5.0% or less, defects causing dielectric breakdown of the heat dissipation sheet can be reduced, and thus the insulating property of the heat dissipation sheet can be further improved. From such a viewpoint, the void area rate in the cross section of the heat dissipation sheet of the present invention when cut in the thickness direction is more preferably 4.0% or less, and further preferably 3.0% or less. The lower the number of defects causing dielectric breakdown of the heat dissipation sheet, the better. Therefore, a lower limit of the void area rate in the cross section of the heat dissipation sheet of the present invention when cut in the thickness direction is 0%. From the viewpoint of productivity, the void area rate may be 0.5% or more. The void area rate in the cross section of the heat dissipation sheet when cut in the thickness direction can be measured by a method described in Examples to be described later. By performing the surface treatment of the boron nitride powder using the predetermined silicone oil, the occurrence of voids at the interface between boron nitride particles and a resin can be prevented, and thereby the void area rate in the cross section of the heat dissipation sheet when cut in the thickness direction can be 5.0% or less.

(Thickness)

A thickness of the heat dissipation sheet of the present invention is not particularly limited, and is preferably 0.08 mm to 3.0 mm, more preferably 0.15 mm to 2.0 mm, and further preferably 0.2 mm to 1.5 mm.

(Void Diameter)

Diameters of all voids in the cross section of the heat dissipation sheet of the present invention when cut in the thickness direction are measured, the measured diameters are arranged in descending order of the diameters, and an average diameter of the top 10 diameters is defined as a void diameter. In this case, the void diameter is preferably 9.5 m or less. When the void diameter is 9.5 μm or less, the dielectric breakdown voltage of the heat dissipation sheet can be further improved. When a shape of the void is not circular, a diameter of a circle circumscribing the void is defined as the void diameter. The void diameter can be measured by a method described in Examples to be described later.

The heat dissipation sheet of the present invention is preferably formed by molding a thermally conductive resin composition containing a boron nitride powder and a resin. Hereinafter, the boron nitride and the resin to be used in the heat dissipation sheet of the present invention, and the thermally conductive resin composition containing the same will be described.

(Boron Nitride Powder)

The boron nitride powder to be used in the heat dissipation sheet of the present invention is a boron nitride powder surface-treated with a reactive silicone oil having a mass average molecular weight of 5000 to 200000. By treating the boron nitride powder with the reactive silicone oil, wettability of the boron nitride powder to the resin is improved, and the heat dissipation sheet with less voids can be produced. Accordingly, the insulating property of the heat dissipation sheet can be improved. When the wettability of the boron nitride powder to the resin deteriorates, gaps may occur between the surface of boron nitride particles and the resin, and voids, particularly, linear voids may occur. The reactive silicone oil makes the resin flexible and reduces the surface hardness of the heat dissipation sheet. Accordingly, the adhesion of the heat dissipation sheet to the heat-generating element is increased, and the thermal conductivity of the heat dissipation sheet can be improved.

(Reactive Silicone Oil)

<Reactive Group of Reactive Silicone Oil>

The reactive silicone oil is obtained by introducing a hydroxy group and a chemically reactive organic group into a part of a methyl group of dimethylpolysiloxane. Examples of the chemically reactive organic group include an amino group, an epoxy group, a carboxy group, an acid anhydride group, a carbinol group, a phenol group, a mercapto group, and a (meth)acrylic group. From the viewpoint that the reactive silicone oil can be bonded to the surface of the boron nitride particles by a dehydration condensation reaction with an OH group on the surface of the boron nitride particles, the reactive silicone oil used for the boron nitride powder to be used in the heat dissipation sheet of the present invention is preferably a reactive silicone oil obtained by introducing a hydroxy group into a part of a methyl group of dimethylpolysiloxane. A position of the hydroxy group in the reactive silicone oil may be an end or a side chain. That is, the reactive silicone oil may have a silanol group (Si—OH) at at least one position of the end and the side chain. Further, the reactive silicone oil preferably has an OH group at both ends or one end. However, in the case where the reactive silicone oil has OH groups at both ends, when the resin is a silicone resin, the silicone resin has a silanol group (Si—OH), and thus the OH group at one end of the reactive silicone oil may be subjected to a dehydration condensation reaction with an OH group of the boron nitride particle, and the OH group at the other end of the reactive silicone oil may be subjected to a dehydration condensation reaction with the silanol group in the silicone resin. Alternatively, the OH group at one end of the reactive silicone oil may be subjected to a dehydration condensation reaction with an OH group of one boron nitride particle, and the OH group at the other end of the reactive silicone oil may be subjected to a dehydration condensation reaction with an OH group of the same or another boron nitride particle. From such a viewpoint, the reactive silicone oil more preferably has OH groups at both ends. That is, the reactive silicone oil more preferably has silanol groups (Si—OH) at both ends.

<Mass Average Molecular Weight>

The mass average molecular weight of the reactive silicone oil used for the boron nitride powder to be used in the heat dissipation sheet of the present invention is preferably 5000 to 200000. When the mass average molecular weight of the reactive silicone oil is 5000 or more, an effect of a long-chain polydimethylsiloxane in the reactive silicone oil in improving the wettability of the boron nitride powder to the resin, particularly the silicone resin, is increased. An effect of the long-chain polydimethylsiloxane in the reactive silicone oil in improving slidability of the boron nitride particles is also increased. When a thermally conductive resin composition obtained by mixing a boron nitride powder with a resin with high filling flows, boron nitride particles may come into contact with each other. Therefore, when the slidability of the boron nitride particles is good, fluidity of the thermally conductive resin composition obtained by mixing a boron nitride powder with a resin with high filling can be improved. On the other hand, when the mass average molecular weight of the reactive silicone oil is 200000 or less, the boron nitride powder can be easily uniformly surface-treated using the reactive silicone oil. The surface hardness of the heat dissipation sheet can be further reduced. From such a viewpoint, the mass average molecular weight of the reactive silicone oil used for the boron nitride powder to be used in the heat dissipation sheet of the present invention may be preferably 7000 or more, 9000 or more, or 10000 or more. An upper limit thereof may be 200000 or less, 180000 or less, 160000 or less, or 150000 or less. The mass average molecular weight of the reactive silicone oil can be measured using gel permeation chromatography after dissolving the reactive silicone oil from the boron nitride powder using an organic solvent (for example, toluene) capable of dissolving the reactive silicone oil.

<Surface Treatment>

As described above, the boron nitride powder to be used in the heat dissipation sheet of the present invention is a boron nitride powder surface-treated with the reactive silicone oil. The surface treatment with the reactive silicone oil may be performed by dry-mixing the boron nitride powder and the reactive silicone oil, or may be performed by wet-mixing the boron nitride powder and the reactive silicone oil with a solvent added thereto. As the solvent, for example, an aromatic solvent having a relatively small solubility parameter (SP value), such as toluene or xylene, can be used. However, since it may be difficult to separate the boron nitride powder from the solvent in which the reactive silicone oil is dissolved, the surface treatment with the reactive silicone oil is preferably performed by dry mixing. For example, the boron nitride powder and the reactive silicone oil can be dry-mixed as follows. A processing device equipped with a stirrer is prepared, and the processing device is filled with the boron nitride powder. The stirrer is used for high speed stirring, and a stock solution of the reactive silicone oil or a solution obtained by dissolving the reactive silicone oil in a solvent is added dropwise or sprayed thereto. The solvent is, for example, an aromatic solvent having a relatively small solubility parameter (SP value), such as toluene or xylene. Examples of the processing device equipped with a stirrer include a Henshell mixer, a super mixer, a V-type blender, and a rotation and revolution mixer. In order to promote the dehydration condensation reaction between the reactive silicone oil and the OH group of the boron nitride particle, the surface treatment with the reactive silicone oil may be performed while heating. In order to remove moisture generated by the dehydration condensation reaction between the reactive silicone oil and the OH group of the boron nitride particle, the boron nitride powder surface-treated with the reactive silicone oil may be subjected to a drying treatment. In order to sufficiently fit the reactive silicone oil into the surface of the boron nitride particle in the boron nitride powder, the boron nitride powder surface-treated with the reactive silicone oil may be aged.

<Amount to be Added>

In view of a balance between the effect of the reactive silicone oil in improving the wettability of the boron nitride powder to the resin and an increase in production cost of the boron nitride powder due to addition of the reactive silicone oil, an amount of the reactive silicone oil to be added is preferably 0.01 parts by mass to 50 parts by mass, more preferably 0.1 parts by mass to 30 parts by mass, and further preferably 0.3 parts by mass to 15 parts by mass, with respect to 100 parts by mass of the boron nitride powder.

<Infrared Absorption Peak>

A peak intensity of an infrared absorption peak (3220 $cm^{-1}$±10 $cm^{-1}$) attributed to B—OH stretching vibration in an infrared spectrum of the boron nitride powder, which is measured by a transmission method (a KBr tablet method) under a one-hundredth-dilution condition, is preferably 0.1 or more. When the peak intensity of the infrared absorption peak attributed to the B—OH stretching vibration is 0.1 or more, the wettability of the boron nitride powder to the resin can be further improved by the reactive silicone oil. From such a viewpoint, the peak intensity of the infrared absorption peak attributed to the B—OH stretching vibration is more preferably 0.2 or more, and further preferably 0.3 or more. An upper limit thereof may be 1.0 or less, 0.8 or less, or 0.7 or less. The peak intensity of the infrared absorption peak is a height of the infrared absorption peak.

Whether the boron nitride powder is surface-treated with the reactive silicone oil may be determined by measuring the infrared spectrum of the boron nitride powder. For example, in the case where the infrared spectrum of the boron nitride powder surface-treated with the reactive silicone oil is measured by the transmission method (the KBr tablet method), an infrared absorption peak (1100 $cm^{-1}$±10 $cm^{-1}$) attributed to bending vibration of Si—O—Si of the reactive silicone oil and an infrared absorption peak (1020 $cm^{-1}$±10 $cm^{-1}$) attributed to bending vibration of Si—O—C of the reactive silicone oil may appear in the obtained infrared spectrum. From such a viewpoint, the infrared spectrum of the boron nitride powder to be used in the heat dissipation sheet of the present invention preferably has the infrared absorption peak (1100 $cm^{-1}$±10 $cm^{-1}$) attributed to the bending vibration of Si—O—Si and the infrared absorption peak (1020 $cm^{-1}$±10 $cm^{-1}$) attributed to the bending vibration of Si—O—C.

The peak intensity of the infrared absorption peak (1100 $cm^{-1}$±10 $cm^{-1}$) attributed to the bending vibration of Si—O—Si of the reactive silicone oil in the infrared spectrum of the boron nitride powder of the present invention, which is measured by the transmission method (the KBr tablet method) under the one-hundredth-dilution condition, is preferably 0.3 or more. When the peak intensity of the infrared absorption peak attributed to the bending vibration of Si—O—Si is 0.3 or more, the wettability of the boron nitride powder to the resin can be further improved by the reactive silicone oil. From such a viewpoint, the peak intensity of the infrared absorption peak attributed to the bending vibration of Si—O—Si is more preferably 0.4 or more, and further preferably 0.5 or more. An upper limit thereof may be 1.0 or less, 0.9 or less, or 0.8 or less. The peak intensity of the infrared absorption peak is a height of the infrared absorption peak.

<Blocky Boron Nitride Particles>

Blocky boron nitride particles are blocky boron nitride particles formed by aggregating hexagonal boron nitride primary particles, and have a crushing strength of 5 MPa or more. As described above, the primary particles of the boron nitride powder have a scaly shape, and the flat surface (the (0001) plane) thereof is very inert. On the other hand, OH groups are covalently bonded to boron atoms on surfaces of end faces of the primary particles of the boron nitride powder. Generally, in synthesis of the boron nitride powder, the (0001) plane of boron nitride preferentially grows, and thus an area of the end face of the primary particle of the boron nitride powder relatively decreases. Therefore, the primary particle of the boron nitride powder generally has a smaller amount of OH groups as the particle size increases. On the other hand, in the blocky boron nitride particles, since boron nitride is produced using boron carbide as a raw material, crystal growth of the (0001) plane of the boron nitride primary particles can be slightly prevented. Therefore, the area of the end face of the boron nitride primary particle increases, and as a result, the amount of OH groups increases. As described above, the reactive silicone oil is bonded to the surface of the boron nitride particles by the dehydration condensation reaction with OH groups on the surfaces of the boron nitride particles. From such a viewpoint, the boron nitride powder to be used in the heat dissipation sheet of the present invention preferably contains the blocky boron nitride particles.

From the viewpoint of the surface treatment with the reactive silicone oil, a content of the blocky boron nitride particles in the boron nitride powder to be used in the heat dissipation sheet of the present invention is preferably 30 mass % or more, more preferably 40 mass % or more, and further preferably 50 mass % or more. In order to incorporate the boron nitride powder into the resin with high filling, the boron nitride powder preferably contains boron nitride particles having a small particle size. However, it may be difficult to produce blocky boron nitride particles having a small particle size. From such a viewpoint, a content of the blocky boron nitride particles in the boron nitride powder to be used in the heat dissipation sheet of the present invention is preferably 90 mass % or less, more preferably 80 mass % or less, and further preferably 70 mass % or less. As described above, the reactive silicone oil also has the effect of improving the slidability of the boron nitride particles, and thus when the boron nitride powder is incorporated into the resin with high filling, the effect of the boron nitride powder to be used in the heat dissipation sheet of the present invention is further enhanced.

<Particle Size Distribution>

As shown in FIG. 1, a particle size distribution of the boron nitride powder to be used in the heat dissipation sheet of the present invention preferably has at least a first local maximum point (MAX1), a second local maximum point (MAX2) at which a particle size is larger than that at the first local maximum point (MAX1), and a third local maximum point (MAX3) at which a particle size is larger than that at the second local maximum point (MAX2). The particle size at the first local maximum point (MAX1) is 0.4 μm or more and less than 10 m, the particle size at the second local maximum point (MAX2) is 10 μm or more and less than 40 m, and the particle size at the third local maximum point (MAX3) is m or more and 110 μm or less. Accordingly, fillability of the boron nitride powder in the heat dissipation sheet can be enhanced, and the thermal conductivity of the heat dissipation sheet can be improved. The fillability of the boron nitride powder in the heat dissipation sheet can be enhanced, and thus formation of voids between the boron nitride particles and the resin can be further prevented. The particle size distribution of the boron nitride powder to be used in the heat dissipation sheet of the present invention can be measured by a method in Examples to be described later. The boron nitride powder to be used in the heat dissipation sheet of the present invention is surface-treated with the reactive silicone oil, and thus even when the heat dissipation sheet is highly filled with boron nitride, viscosity of the thermally conductive resin composition can be reduced.

The particle size at the first local maximum point (MAX1) is preferably 0.4 μm or more and less than 10 μm. When the particle size at the first local maximum point (MAX1) is 0.4 μm or more and less than 10 m, the fillability of the boron nitride powder in the heat dissipation sheet can be further enhanced, and the thermal conductivity of the heat dissipation sheet can be further improved. The formation of voids between the boron nitride particles and the resin can be further prevented. From such a viewpoint, the particle size at the first local maximum point (MAX1) is more preferably 2.0 μm to 9.0 μm, and further preferably 3.0 μm to 8.0 μm.

The particle size at the second local maximum point (MAX2) is preferably 10 μm or more and less than 40 μm. When the particle size at the second local maximum point (MAX2) is 10 μm or more and less than 40 m, the fillability of the boron nitride powder in the heat dissipation sheet can be further enhanced, and the thermal conductivity of the heat dissipation sheet can be further improved. The formation of voids between the boron nitride particles and the resin can be further prevented. From such a viewpoint, the particle size at the second local maximum point (MAX2) is more preferably 15 μm to 36 m, and further preferably 18 μm to 30 km.

The particle size at the third local maximum point (MAX3) is preferably 40 μm to 110 μm. When the particle size at the third local maximum point (MAX3) is 40 μm to 110 m, the fillability of the boron nitride powder in the heat dissipation sheet can be further enhanced, and the thermal conductivity of the heat dissipation sheet can be further improved. The formation of voids between the boron nitride particles and the resin can be further prevented. From such a viewpoint, the particle size at the third local maximum point (MAX3) is more preferably 50 μm to 100 m, and further preferably 65 μm to 90 km.

An integrated amount (V1) of frequency between a peak start and a peak end in a peak having the first local maximum point (MAX1) is preferably 1 vol % to 18 vol %. When the integrated amount (V1) is 1 vol % to 18 vol %, the fillability of the boron nitride powder in the heat dissipation sheet can be further enhanced, and the thermal conductivity of the heat dissipation sheet can be further improved. The formation of voids between the boron nitride particles and the resin can be further prevented. From such a viewpoint, the integrated amount (V1) is more preferably 5 vol % to 12 vol %. The peak start in the peak having the first local maximum point (MAX1) is a local minimum point on a side where the particle size is smaller than that at the first local maximum point (MAX1). When there is no local minimum point on the side where the particle size is smaller than that at the first local maximum point (MAX1), the peak start is an end (DS) on a side where the particle size of the particle size distribution is small. The peak end in the peak having the first local maximum point (MAX1) is a local minimum point (MIN1) on a side where the particle size is larger than that at the first local maximum point (MAX1). The integrated amount (V1) of frequency is a value obtained by subtracting a frequency of the particle size at the local minimum point (MIN1) on the side where the particle size is larger than that at the first local maximum point (MAX1) from an integrated amount of frequency from the particle size at the local minimum point on the side where the particle size is smaller than that at the first local maximum point (MAX1) or the particle size at the end (DS) on the side where the particle size of the particle size distribution is small to the particle size at the local minimum point (MIN1) on the side where the particle size is larger than that at the first local maximum point (MAX1). The reason why the frequency of the particle size at the local minimum point (MIN1) on the side where the particle size is larger than that at the first local maximum point (MAX1) is subtracted is to prevent the frequency of the particle size of the local minimum point (MIN1) on the side where the particle size is larger than that at the first local maximum point (MAX1) from being added in both the integrated amount of the frequency between the peak start and the peak end in the peak having the first local maximum point (MAX1) and an integrated amount of frequency between a peak start and a peak end in a peak having the second local maximum point (MAX2).

An integrated amount (V2) of frequency between the peak start and the peak end in the peak having the second local maximum point (MAX2) is preferably 9 vol % to 27 vol %. When the integrated amount (V2) is 9 vol % to 27 vol %, the fillability of the boron nitride powder in the heat dissipation sheet can be further enhanced, and the thermal conductivity of the heat dissipation sheet can be further improved. The formation of voids between the boron nitride particles and the resin can be further prevented. From such a viewpoint, the integrated amount (V2) is more preferably 15 vol % to 21 vol %. The peak start in the peak having the second local maximum point (MAX2) is the local minimum point (MIN1) on the side where the particle size is smaller than that at the second local maximum point (MAX2). The peak end in the peak having the second local maximum point (MAX2) is a local minimum point (MIN2) on a side where the particle size is larger than that at the second local maximum point (MAX2). The integrated amount (V2) of frequency is a value obtained by subtracting a frequency of the particle size at the local minimum point (MIN2) on the side where the particle size is larger than that at the second local maximum point (MAX2) from an integrated amount of frequency from the particle size at the local minimum point (MIN1) on the side where the particle size is smaller than that at the second local maximum point (MAX2) to the particle size at the local minimum point (MIN2) on the side where the particle size is larger than that at the second local maximum point (MAX2). The reason why the frequency of the particle size at the local minimum point (MIN2) on the side where the particle size is larger than that at the second local maximum point (MAX2) is subtracted is to prevent the frequency of the particle size at the local minimum point (MIN2) on the side where the particle size is larger than that at the second local maximum point (MAX2) from being added in both the integrated amount of the frequency between the peak start and the peak end in the peak having the second local maximum point (MAX2) and an integrated amount of frequency between a peak start and a peak end in a peak having the third local maximum point (MAX3).

An integrated amount (V3) of frequency between the peak start and the peak end in the peak having the third local maximum point (MAX3) is preferably 66 vol % to 90 vol %. When the integrated amount (V3) is 66 vol % to 90 vol %, the fillability of the boron nitride powder in the heat dissipation sheet can be further enhanced, and the thermal conductivity of the heat dissipation sheet can be further improved. The formation of voids between the boron nitride particles and the resin can be further prevented. From such a viewpoint, the integrated amount (V3) is more preferably 72 vol % to 80 vol %. The peak start in the peak having the third local maximum point (MAX3) is the local minimum point (MIN2) on the side where the particle size is smaller than that at the third local maximum point (MAX3). The peak end in the peak having the third local maximum point (MAX3) is a local minimum point on a side where the particle size is larger than that at the third local maximum point (MAX3). When there is no local minimum point on the side where the particle size is larger than that at the third local maximum point (MAX3), the peak end is an end (DE) on the side where the particle size of the particle size distribution is larger. The integrated amount (V3) of frequency is a value obtained by subtracting a frequency of the particle size at the local minimum point on the side where the particle size is larger than that at the third local maximum point (MAX3) from an integrated amount of frequency from the particle size at the local minimum point (MIN2) on the side where the particle size is smaller than that at the third local maximum point (MAX3) to the particle size at the local minimum point on the side where the particle size is larger than that at the third local maximum point (MAX3). Alternatively, the integrated amount (V3) of frequency is an integrated amount of frequency from the particle size at the local minimum point (MIN2) on the side where the particle size is smaller than that at the third local maximum point (MAX3) to the particle size of the end (PE) on the side where the particle size of the particle size distribution is larger. The reason why the frequency of the particle size at the local minimum point on the side where the particle size is larger than that at the third local maximum point (MAX3) is subtracted is to prevent the frequency of the particle size at the local minimum point on the side where the particle size is larger than that at the third local maximum point (MAX3) from being added in both the integrated amount of the frequency between the peak start and the peak end in the peak having the third local maximum point (MAX3) and an integrated amount of frequency between a peak start and a peak end in a peak having a local maximum point on the side where the particle size is larger than that at the third local maximum point, which is adjacent to the third local maximum point (MAX3).

As long as the fillability of the boron nitride powder in the heat dissipation sheet can be enhanced, the particle size distribution of the boron nitride powder to be used in the heat dissipation sheet of the present invention may have other local maximum points in addition to the first to third local maximum points described above.

<Method for Producing Boron Nitride Powder>

An example of a method for producing the boron nitride powder to be used in the heat dissipation sheet of the present invention will be described below.

The boron nitride powder to be used in the heat dissipation sheet of the present invention can be produced, for example, by preparing a first boron nitride powder whose particle size distribution has the first local maximum point, a second boron nitride powder whose particle size distribution has the second local maximum point, and a third boron nitride powder whose particle size distribution has the third local maximum point, respectively, mixing the prepared first to third boron nitride powders to prepare a blend of the boron nitride powders, and subjecting the blend to a surface treatment using a reactive silicone oil. The boron nitride powder to be used in the heat dissipation sheet of the present invention may be produced by surface-treating the respective first to third boron nitride powders using a reactive silicone oil and mixing the surface-treated first to third boron nitride powders.

Among the first to third boron nitride powders, the second and third boron nitride powders are preferably boron nitride powders each containing at least blocky boron nitride particles. The first boron nitride powder may contain blocky boron nitride particles, and preferably contains hexagonal boron nitride primary particles. The local maximum point of each of the first to third boron nitride powders means a vertex of the peak in the particle size distribution of each of the first to third boron nitride powders. The particle size distributions of the first to third boron nitride powders are measured in the same manner as the particle size distribution of the boron nitride powder described above.

In the mixing step, the first to third boron nitride powders may be mixed such that a volume ratio of the third boron nitride powder is larger than a volume ratio of the second boron nitride powder and then the volume ratio of the second boron nitride powder is larger than a volume ratio of the first boron nitride powder. Accordingly, the fillability of the boron nitride powder can be further enhanced. The volume ratio of the third boron nitride powder is preferably 66 parts by volume to 90 parts by volume, and more preferably 72 parts by volume to 80 parts by volume, with respect to the total of 100 parts by volume of the first to third boron nitride powders, from the viewpoint of improving the thermal conductivity of the heat dissipation sheet. The volume ratio of the second boron nitride powder is preferably 9 parts by volume to 27 parts by volume, and more preferably 15 parts by volume to 21 parts by volume, with respect to the total of 100 parts by volume of the first to third boron nitride powders, from the viewpoint of improving the thermal conductivity of the heat dissipation sheet. The volume ratio of the first boron nitride powder is preferably 1 part by volume to 18 parts by volume, and more preferably 5 parts by volume to 12 parts by volume, with respect to the total of 100 parts by volume of the first to third boron nitride powders, from the viewpoint of improving the thermal conductivity of the heat dissipation sheet.

The first to third boron nitride powders can be produced by, for example, a production method including a pulverizing step of pulverizing blocky boron carbide, a nitriding step of nitriding the pulverized boron carbide to obtain boron carbonitride, and a decarburization step of decarburizing the boron carbonitride. In scaly hexagonal boron nitride particles, which are primary particles of the boron nitride powder produced in this manner, an area of an end face thereof becomes large, and thus an amount of OH groups present on the surface of the boron nitride particles can be increased.

In the pulverizing step, blocky carbon boron (a boron carbide lump) is pulverized using a general pulverizer or shredder. At this time, for example, the boron carbide powder having a desired local maximum point can be obtained by adjusting a pulverization time and a charged amount of the boron carbide lump. The local maximum point of the boron carbide powder can be measured in the same manner as the local maximum point of the boron nitride powder described above. As described above, by adjusting the local maximum point of the boron carbide powder to be close to the desired local maximum point of the boron nitride powder, the first to third boron nitride powders having the above-described local maximum points can be obtained.

Subsequently, in the nitriding step, boron carbonitride is obtained by firing the boron carbide powder under a pressurized condition and an atmosphere that allows a nitriding reaction to proceed.

The atmosphere in the nitriding step is an atmosphere that allows a nitriding reaction to proceed, and may be, for example, nitrogen gas and ammonia gas, and these may be used alone or in combination of two or more thereof. The atmosphere is preferably nitrogen gas from the viewpoint of ease of nitriding and cost. A content of the nitrogen gas in the atmosphere is preferably 95 vol % or more, and more preferably 99.9 vol % or more.

A pressure in the nitriding step is preferably 0.6 MPa or more, and more preferably 0.7 MPa or more, and is preferably 1.0 MPa or less, and more preferably 0.9 MPa or less. The pressure is further preferably 0.7 MPa to 1.0 MPa. A firing temperature in the nitriding step is preferably 1800° C. or higher, and more preferably 1900° C. or higher, and is preferably 2400° C. or lower, and more preferably 2200° C. or lower. The firing temperature is further preferably 1800° C. to 2200° C. The pressure condition and the firing temperature are preferably 1800° C. or higher and 0.7 MPa to 1.0 MPa, since they allow the nitridation of boron carbide to proceed more favorably and are industrially appropriate conditions.

A firing time in the nitriding step is appropriately selected within a range where nitriding sufficiently proceeds, and may be preferably 6 hours or longer, and more preferably 8 hours or longer, and may be preferably 30 hours or shorter, and more preferably 20 hours or shorter.

In the decarburization step, the boron carbonitride obtained in the nitriding step is subjected to a heat treatment in which the boron carbonitride is held at a predetermined holding temperature for a certain period of time under an atmosphere at a normal pressure or higher. Accordingly, blocky boron nitride particles can be obtained by aggregating the decarburized and crystallized hexagonal boron nitride primary particles.

The atmosphere in the decarburization step is a normal pressure (atmospheric pressure) atmosphere or a pressurized atmosphere. In the case of a pressurized atmosphere, the pressure may be, for example, 0.5 MPa or less, and preferably 0.3 MPa or less.

In the decarburization step, for example, first, the temperature is increased to a predetermined temperature (a temperature at which the decarburization can be started), and then the temperature is further increased to a holding temperature at a predetermined temperature increasing rate. The predetermined temperature (the temperature at which the decarburization can be started) can be set depending on the system, and may be, for example, 1000° C. or higher, and 1500° C. or lower, and preferably 1200° C. or lower. A rate at which the temperature is increased from the predetermined temperature (the temperature at which the decarburization can be started) to the holding temperature may be, for example, 5° C./min or less, and preferably 4° C./min or less, 3° C./min or less, or 2° C./min or less.

The holding temperature is preferably 1800° C. or higher, and more preferably 2000° C. or higher, from the viewpoint of easily causing grain growth satisfactorily and further improving the thermal conductivity of the obtained boron nitride powder. The holding temperature may be preferably 2200° C. or lower, and more preferably 2100° C. or lower.

The holding time at the holding temperature is appropriately selected within a range where crystallization sufficiently proceeds, and may be, for example, longer than 0.5 hours, and is preferably 1 hour or longer, more preferably 3 hours or longer, further preferably 5 hours or longer, and particularly preferably 10 hours or longer, from the viewpoint of easily causing grain growth satisfactorily. The holding time at the holding temperature may be, for example, shorter than 40 hours, and is preferably 30 hours or shorter, and more preferably 20 hours or shorter, from the viewpoint of reducing a decrease in particle strength due to excessive grain growth and reducing the cost.

In the decarburization step, in addition to the boron carbonitride obtained in the nitriding step, a boron source may be mixed as a raw material for decarburization and crystallization. Examples of the boron source include boric acid, boron oxide, and a mixture thereof. In this case, other additives used in the technical field may be further used as necessary.

A mixing ratio of the boron carbonitride and the boron source is appropriately selected. When boric acid or boron oxide is used as the boron source, a ratio of boric acid or boron oxide may be, for example, 100 parts by mass or more, and is preferably 150 parts by mass or more, and may be, for example, 300 parts by mass or less, and is preferably 250 parts by mass or less, with respect to 100 parts by mass of boron carbonitride.

A step (a classifying step) of classifying the boron nitride powder obtained as described above with a sieve to obtain a boron nitride powder having a desired particle size distribution may be performed. Accordingly, the first to third boron nitride powders having the desired local maximum points can be more suitably obtained.

The obtained first to third boron nitride powders are mixed to obtain a blend having a particle size distribution having the first to third local maximum points. The mixing method is not particularly limited as long as the first to third boron nitride powders can be uniformly mixed. For example, the first to third boron nitride powders may be mixed using a container-rotary mixing device, the first to third boron nitride powders may be mixed using a container-fixed mixing device, or the first to third boron nitride powders may be mixed using a fluid dynamic mixing device.

The obtained blend is surface-treated with the reactive silicone oil. As described above, the surface treatment with the reactive silicone oil may be performed by dry-mixing the boron nitride powder and the reactive silicone oil, or may be performed by wet-mixing the boron nitride powder and the reactive silicone oil with a solvent added thereto. However, the surface treatment with the reactive silicone oil is preferably performed by dry mixing. For example, a processing device equipped with a stirrer is prepared, and the processing device is filled with the boron nitride powder. The stirrer is used for high speed stirring, and a stock solution of the reactive silicone oil or a solution obtained by dissolving the reactive silicone oil in a solvent is added dropwise or sprayed thereto. Examples of the processing device equipped with a stirrer include a Henshell mixer, a super mixer, a V-type blender, and a rotation and revolution mixer. Examples of the solvent include an aromatic solvent having a relatively small solubility parameter (SP value), such as toluene or xylene. In order to promote the dehydration condensation reaction between the reactive silicone oil and the OH group of the boron nitride particle, the surface treatment with the reactive silicone oil may be performed while heating. In order to remove moisture generated by the dehydration condensation reaction between the reactive silicone oil and the OH group of the boron nitride particle, the boron nitride powder surface-treated with the reactive silicone oil may be subjected to a drying treatment. In order to sufficiently fit the reactive silicone oil into the surface of the boron nitride particle in the boron nitride powder, the boron nitride powder surface-treated with the reactive silicone oil may be aged.

In view of a balance between the effect of the reactive silicone oil in improving the wettability of the boron nitride powder to the resin and an increase in production cost of the boron nitride powder due to addition of the reactive silicone oil, an amount of the reactive silicone oil to be added is preferably 0.01 parts by mass to 50 parts by mass, more preferably 0.1 parts by mass to 30 parts by mass, and further preferably 0.3 parts by mass to 15 parts by mass, with respect to 100 parts by mass of the boron nitride powder.

(Resin)

Examples of the resin to be used in the heat dissipation sheet of the present invention include an epoxy resin, a silicone resin (including silicone rubber), an acrylic resin, a phenolic resin, a melamine resin, a urea resin, an unsaturated polyester, a fluororesin, a polyamide (for example, polyimide, polyamide-imide, and polyetherimide), a polyester (for example, polybutylene terephthalate, and polyethylene terephthalate), a polyphenylene ether, a polyphenylene sulfide, a wholly aromatic polyester, a polysulfone, a liquid crystal polymer, a polyethersulfone, a polycarbonate, a maleimide modified resin, an ABS resin, an acrylonitrile acrylic rubber-styrene (AAS) resin, and an acrylonitrile ethylene propylene diene rubber-styrene (AES) resin. Among them, a silicone resin is preferable from the viewpoint of heat resistance, flexibility, and adhesion to a heat sink. The silicone resin is preferably cured by vulcanization with an organic peroxide. The viscosity of the thermally conductive resin composition at 25° C. is, for example, 100,000 cp or less, from the viewpoint of improving flexibility of a sheet-shaped molded body.

(Thermal Conductive Resin Composition)

In the thermally conductive resin composition, a content of the boron nitride powder is preferably 30 vol % to 85 vol %, and more preferably 40 vol % to 80 vol %, with respect to the total of 100 vol % of the boron nitride powder and the resin. When the content of the boron nitride powder is 30 vol % or more, the thermal conductivity is improved, and a sufficient heat dissipation performance is easily obtained. When the content of the boron nitride powder is 85 vol % or less, a tendency for voids to occur during molding can be reduced, and a decrease in insulating property and mechanical strength can be reduced. A content of the resin is preferably 15 vol % to 70 vol %, and more preferably 20 vol % to 60 vol %, with respect to the total of 100 vol % of the boron nitride powder and the resin.

In order to adjust the viscosity of the thermally conductive resin composition, the thermally conductive resin composition may further contain a solvent. The solvent is not particularly limited as long as it can dissolve the resin and can be easily removed from the applied thermally conductive resin composition after the thermally conductive resin composition is applied. When the resin is a silicone resin, examples of the solvent include toluene, xylene, and a chlorine hydrocarbon. From the viewpoint of easy removal, toluene is preferable among these solvents. A content of the solvent can be appropriately selected depending on the desired viscosity of the thermally conductive resin composition. The content of the solvent is, for example, 40 parts by mass to 200 parts by mass, with respect to 100 parts by mass of components of the thermally conductive resin composition other than the solvent.

The thermally conductive resin composition may contain other components than the boron nitride powder, the resin component, and the solvent. The other components include inorganic fillers, additives, and impurities other than the boron nitride powder. A content of the other components is preferably 5 parts by mass or less, more preferably 3 parts by mass or less, and further preferably 1 part by mass or less, with respect to the total of 100 parts by mass of the boron nitride powder and the resin.

The heat dissipation sheet preferably contains a glass cloth. Accordingly, damage to the heat dissipation sheet during handling can be prevented. In order to prevent formation of a gap between the thermally conductive resin composition and the glass cloth, the glass cloth may be subjected to a silane coupling treatment.

(Method for Producing Heat Dissipation Sheet)

The heat dissipation sheet of the present invention can be produced, for example, by a production method including a step (A) of blending the boron nitride powder of the present invention and a resin to produce a thermally conductive resin composition, a step (B) of molding the thermally conductive resin composition into a sheet shape to produce a thermally conductive resin composition sheet, and a step (C) of heating and pressurizing the thermally conductive resin composition sheet.

(Step (A))

In the step (A), the boron nitride powder and the resin are blended to prepare a thermally conductive resin composition. The boron nitride powder and the resin to be used in the step (A) have already been described, and description thereof will be omitted.

(Step (B))

In the step (B), the thermally conductive resin composition is molded into a sheet shape to produce a thermally conductive resin composition sheet. For example, the thermally conductive resin composition can be molded into a sheet shape by a doctor blade method or calendaring. However, when the thermally conductive resin composition passes through a calendar roll, a part of blocky boron nitride particles may be peeled off from blocky boron nitride particles in the thermally conductive resin composition. Therefore, it is preferable to mold the thermally conductive resin composition into a sheet shape by the doctor blade method.

(Step (C))

In the step (C), the thermally conductive resin composition sheet is heated and pressurized. Accordingly, fillability of the boron nitride powder in the heat dissipation sheet can be further enhanced, and the thermal conductivity of the heat dissipation sheet can be further improved. Accordingly, voids in the heat dissipation sheet can be further reduced, and thus the thermal conductivity of the heat dissipation sheet can be further improved, and the insulating property of the heat dissipation sheet can be improved. From the viewpoint of improving the fillability of the boron nitride powder and reducing voids in the heat dissipation sheet, a heating temperature of the thermally conductive resin composition sheet is preferably 120° C. to 200° C., and more preferably 130° C. to 180° C. A pressure applied to the thermally conductive resin composition sheet is preferably 1 MPa to 10 MPa, and more preferably 3 MPa to 7 MPa.

In the step (C), a laminate of the thermally conductive resin composition sheet and the glass cloth may be prepared, and the laminate may be heated and pressurized under vacuum. Accordingly, a heat dissipation sheet including a glass cloth can be produced.

EXAMPLE

Hereinafter, the present invention will be described in detail with reference to Examples and Comparative Examples. The present invention is not limited to the following Examples.

Boron nitride powders (raw material boron nitride powders) used as raw materials for boron nitride powders in Examples and Comparative Examples were evaluated as follows.

(Average Particle Size)

An average particle size of the raw material boron nitride powder was measured using a laser diffraction scattering method particle size distribution measuring device (LS-13 320) manufactured by Beckman Coulter, Inc. For the obtained average particle size, an average particle size obtained by measuring the raw material boron nitride powder without applying a homogenizer before a measurement process was adopted as an average particle size value. The obtained average particle size is an average particle size based on a volume statistical value.

The boron nitride powders in Examples and Comparative Examples were evaluated as follows.

(Peak Intensity Derived from Reactive Silicone)

A KBr powder was prepared by crushing small pieces of KBr crystals for making tablets. The boron nitride powder was added to the KBr powder such that a mass ratio of the KBr powder and the boron nitride powder was 100:1, followed by thoroughly mixing. Specifically, the mixture of the KBr powder and the boron nitride powder was uniformly mixed in an agate mortar while being strongly crushed using a pestle, and the mixture was continuously rubbed until a flaky pattern appeared on the surface. The obtained mixture powder was transferred to a KBr tablet molding machine using a spatula, and a transparent tablet was formed by applying a pressure of about 10 tons. The obtained tablet was transferred to a dedicated tablet holder, and an infrared absorption spectrum was measured using a Fourier transform infrared spectrophotometer (trade name: OPUS, manufactured by Bruker Corporation). A peak intensity of an infrared absorption peak (1100 $cm^{-1}$±10 $cm^{-1}$) attributed to bending vibration of Si—O—Si was examined. Then, the infrared absorption peak (1100 $cm^{-1}$±10 $cm^{-1}$) attributed to the bending vibration of Si—O—Si was defined as a peak intensity derived from a reactive silicone. As a reference spectrum, a spectrum obtained by measuring a tablet produced using only the KBr powder was used.

(Particle Size Distribution)

A particle size distribution of the boron nitride powder was measured using a laser diffraction scattering method particle size distribution measuring device (LS-13 320) manufactured by Beckman Coulter, Inc. Before the measurement of the particle size distribution, a treatment of dispersing the boron nitride powder using a homogenizer or the like was not performed.

(B—OH Peak Intensity Derived from BN)

A KBr powder was prepared by crushing small pieces of KBr crystals for making tablets. The boron nitride powder was added to the KBr powder such that a mass ratio of the KBr powder and the boron nitride powder was 100:1, followed by thoroughly mixing. Specifically, the mixture of the KBr powder and the boron nitride powder was uniformly mixed in an agate mortar while being strongly crushed using a pestle, and the mixture was continuously rubbed until a flaky pattern appeared on the surface. The obtained mixture powder was transferred to a KBr tablet molding machine using a spatula, and a transparent tablet was formed by applying a pressure of about 10 tons. The obtained tablet was transferred to a dedicated tablet holder, and an infrared absorption spectrum was measured using a Fourier transform infrared spectrophotometer (trade name: OPUS, manufactured by Bruka Corporation). A peak intensity of an infrared absorption peak (3220 $cm^{-1}$±10 $cm^{-1}$) attributed to B—OH stretching vibration was examined. Then, the infrared absorption peak (3220 $cm^{-1}$±10 $cm^{-1}$) attributed to the B—OH stretching vibration was defined as a B—OH peak intensity derived from BN. As a reference spectrum, a spectrum obtained by measuring a tablet produced using only the KBr powder was used.

Heat dissipation sheets in Examples and Comparative Examples were evaluated as follows.

(Surface Hardness)

A surface hardness of the heat dissipation sheet was measured by a spring hardness test in accordance with SRIS0101 at a test temperature of 25° C. using an Asker C type testing machine (trade name: Asker rubber hardness meter C type, manufactured by KOBUNSHI KEIKI CO., LTD.).

(Dielectric Breakdown Voltage)

A dielectric breakdown voltage of the heat dissipation sheet was measured in accordance with JIS C 2110.

Specifically, the heat dissipation sheet was processed into a size of 10 cm×10 cm, a circular copper layer having a diameter of 25 mm was formed on one surface of the processed heat dissipation sheet, and a copper layer was formed on entire other surface to prepare a test sample.

Electrodes were disposed so as to sandwich the test sample, and an AC voltage was applied to the test sample in an electrical insulating oil (trade name: FC-3283, manufactured by 3M Japan Ltd.). A voltage applied to the test sample was increased from 0 V at such a rate (500 V/s) that dielectric breakdown occurred on average 10 seconds to 20 seconds after start of voltage application. A voltage $V_{15}$ (kV) when dielectric breakdown occurred 15 times for one test sample was measured. Then, the voltage $V_{15}$ (kV) was divided by a thickness (mm) of the test sample to calculate the dielectric breakdown strength (kV/mm).

(Void Area Rate, Void Diameter, and Void Shape)

After a cross section processing of the heat dissipation sheet with a diamond cutter, the heat dissipation sheet was processed by a cross-section polisher (CP) method, fixed to a sample table, and then coated with osmium. The cross section of the heat dissipation sheet was imaged for 10 fields at a magnification of 1000 times using a scanning electron microscope (for example, "JSM-6010 LA" (manufactured by JEOL Ltd.)). Using image analysis software (trade name: Mac-View, manufactured by MOUNTECH Co., Ltd.), the captured image was binarized such that voids can be extracted in the captured image of the cross section of the heat dissipation sheet, and a void area rate in the cross section of the heat dissipation sheet was defined as a void area rate in the cross section of the heat dissipation sheet.

Diameters of all voids extracted by binarizing the captured image were measured, the measured diameters were arranged in descending order of the diameters, and an average diameter of the top 10 diameters was defined as a void diameter. When a shape of the void is not circular, a diameter of a circle circumscribing the void is defined as the void diameter.

Further, the captured image was observed to examine the void shape.

(Thermal Conductivity)

A thermal conductivity of the heat dissipation sheet was measured in accordance with a method described in ASTM D5470:2017.

Boron nitride powders A to G each having one local maximum point, which are raw materials for a boron nitride powder having a plurality of local maximum points, were produced as follows.

(Boron Nitride Powder A)

The boron nitride powder A was produced by boron carbide synthesis, a pressurized nitriding step, and a decarburization and crystallization step as follows.

(Boron Carbide Synthesis Step)

After mixing 100 parts by mass of orthoboric acid (hereinafter referred to as boric acid) manufactured by NIPPON DENKO CO., LTD. and 35 parts by mass of acetylene black (HS100) manufactured by Denka Company Limited using a Henshell mixer, a graphite crucible was filled with the mixture, followed by heating in an arc furnace under an argon atmosphere at 2200° C. for 5 hours to synthesize boron carbide ($B_4C$). The synthesized boron carbide lump was pulverized in a ball mill for 3 hours, sieved to have a particle size of 75 μm or less using a sieve, washed with a nitric acid aqueous solution to remove impurities such as iron, and then filtered and dried to prepare a boron carbide powder having an average particle size of 5.0 μm.

(Pressurized Nitriding Step)

A boron nitride crucible is filled with the synthesized boron carbide, followed by heating under a nitrogen gas atmosphere at conditions of 2000° C. and 9 atm (0.8 MPa) for 10 hours using a resistance heating furnace to form boron carbonitride ($B_4CN_4$).

(Decarburization and Crystallization Step)

After mixing 100 parts by mass of the synthesized boron carbonitride and 90 parts by mass of boric acid using a Henshell mixer, a boron nitride crucible was filled with the mixture, followed by increasing a temperature at a temperature increasing rate of 10° C./min from room temperature to 1000° C. and a temperature increasing rate of 2° C./min from 1000° C. under a nitrogen gas atmosphere and a pressure condition of 0.2 MPa by using a resistance heating furnace, and heating at a firing temperature of 2020° C. for a holding time of 10 hours to synthesize aggregated boron nitride particles by aggregating primary particles into a lump. The synthesized aggregated boron nitride particles were crushed for 15 minutes using a Henshell mixer, and then classified using a nylon sieve with a sieve mesh and having a sieve size of 75 μm. The boron nitride powder A was obtained by crushing and classifying the fired product.

An average particle size (D50) of the obtained boron nitride powder A measured by a laser scattering method was 7.0 μm. As a result of SEM observation, the obtained boron nitride powder A contained scaly boron nitride particles.

(Boron Nitride Powder B)

The boron nitride powder B was produced in the same manner as the boron nitride powder A except that a boron carbide powder having an average particle size of 3 μm was used. An average particle size (D50) of the obtained boron nitride powder B measured by the laser scattering method was 5.0 μm. As a result of SEM observation, the obtained boron nitride powder B contained scaly boron nitride particles.

(Boron Nitride Powder C)

The boron nitride powder C was produced in the same manner as the boron nitride powder A except that a boron carbide powder having an average particle size of 15 μm was used. An average particle size (D50) of the obtained boron nitride powder C measured by the laser scattering method was 20 μm. As a result of SEM observation, the obtained boron nitride powder C contained blocky boron nitride particles formed by aggregating primary particles.

(Boron Nitride Powder D)

The boron nitride powder D was produced in the same manner as the boron nitride powder A except that a boron carbide powder having an average particle size of 12 μm was used. An average particle size (D50) of the obtained boron nitride powder D measured by the laser scattering method was 18 μm. As a result of SEM observation, the obtained boron nitride powder D contained blocky boron nitride particles formed by aggregating primary particles.

(Boron Nitride Powder E)

The boron nitride powder E was produced by a method same as that for the boron nitride powder A except that a boron carbide powder having an average particle size of 70 m was used, sieving was performed to have a particle size of 150 μm or less in the boron carbide synthesis step, and sieving was performed to have a particle size of 150 μm or less in the decarburization and crystallization step. An average particle size (D50) of the obtained boron nitride powder E measured by the laser scattering method was 75 μm. As a result of SEM observation, the obtained boron nitride powder E contained blocky boron nitride particles formed by aggregating primary particles.

(Boron Nitride Powder F)

The boron nitride powder F was produced by a method same as that for the boron nitride powder A except that a boron carbide powder having an average particle size of 55 m was used, sieving was performed to have a particle size of 150 μm or less in the boron carbide synthesis step, and sieving was performed to have a particle size of 150 μm or less in the decarburization and crystallization step. An average particle size (D50) of the obtained boron nitride powder F measured by the laser scattering method was 70 μm. As a result of SEM observation, the obtained boron nitride powder F contained blocky boron nitride particles formed by aggregating primary particles.

(Boron Nitride Powder G)

The boron nitride powder G was produced by a method same as that for the boron nitride powder A except that a boron carbide powder having an average particle size of 32 μm was used, sieving was performed to have a particle size of 75 μm or less in the boron carbide synthesis step, and sieving was performed to have a particle size of 150 μm or less in the decarburization and crystallization step. An average particle size (D50) of the obtained boron nitride powder G measured by the laser scattering method was 45 μm. As a result of SEM observation, the obtained boron nitride powder G contained blocky boron nitride particles formed by aggregating primary particles.

Boron nitride powders 1 to 9 were produced as follows.

[Boron Nitride Powder 1]

The boron nitride powders A, C, and E were mixed such that a volume ratio of the boron nitride powders A, C, and E was 9:18:73 to produce a blend of the boron nitride powders A, C, and E.

100 g of the above-described blend and 1 g of reactive silicone oil (dimethylpolysiloxane with an OH group at one end, trade name: FM-0425, mass average molecular weight: 10,000, manufactured by JNC Corporation) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 1.

[Boron Nitride Powder 2]

The boron nitride powders A, C, and E were mixed such that a volume ratio of the boron nitride powders A, C, and E was 9:18:73 to produce a blend of the boron nitride powders A, C, and E.

100 g of the above-described blend and 1 g of reactive silicone oil (dimethylpolysiloxane with OH groups at both ends, trade name: BLUESIL 48V 80 000, mass average molecular weight: 150,000, manufactured by Elkem Japan Co., Ltd.) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 2.

[Boron Nitride Powder 3]

The boron nitride powders C and E were mixed such that a volume ratio of the boron nitride powders C and E was 20:80 to produce a blend of the boron nitride powders C and E.

100 g of the above-described blend and 1 g of reactive silicone oil (dimethylpolysiloxane with OH groups at both ends, trade name: BLUESIL 48V 3 500, mass average molecular weight: 43,000, manufactured by Elkem Japan Co., Ltd.) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 3.

[Boron Nitride Powder 4]

The boron nitride powders A, C, and E were mixed such that a volume ratio of the boron nitride powders A, C, and E was 9:18:73 to produce a blend of the boron nitride powders A, C, and E.

100 g of the above-described blend and 1 g of reactive silicone oil (dimethylpolysiloxane with OH groups at both ends, trade name: BLUESIL 48V 3 500, mass average molecular weight: 43,000, manufactured by Elkem Japan Co., Ltd.) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 4.

[Boron Nitride Powder 5]

The boron nitride powders A, C, and G were mixed such that a volume ratio of the boron nitride powders A, C, and G was 9:18:73 to produce a blend of the boron nitride powders A, C, and G.

100 g of the above-described blend and 1 g of reactive silicone oil (dimethylpolysiloxane with OH groups at both ends, trade name: BLUESIL 48V 3 500, mass average molecular weight: 43,000, manufactured by Elkem Japan Co., Ltd.) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 5.

[Boron Nitride Powder 6]

The boron nitride powders B, D, and F were mixed such that a volume ratio of the boron nitride powders B, D, and F was 9:18:73 to produce a blend of the boron nitride powders B, D, and F.

100 g of the above-described blend and 1 g of reactive silicone oil (dimethylpolysiloxane with OH groups at both ends, trade name: BLUESIL 48V 3 500, mass average molecular weight: 43,000, manufactured by Elkem Japan Co., Ltd.) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 6.

[Boron Nitride Powder 7]

The boron nitride powders A, C, and G were mixed such that a volume ratio of the boron nitride powders A, C, and G was 9:18:73 to produce a blend of the boron nitride powders A, C, and G.

100 g of the above-described blend and 0.2 g of silane coupling agent (dimethyldimethoxysilane, trade name: DOWSIL Z-6329 Silane, mass average molecular weight: 136, manufactured by Dow Toray Co., Ltd.) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 7.

[Boron Nitride Powder 8]

The boron nitride powders A, C, and E were mixed such that a volume ratio of the boron nitride powders A, C, and E was 9:18:73 to produce the boron nitride powder 8.

[Boron Nitride Powder 9]

The boron nitride powders A, C, and E were mixed such that a volume ratio of the boron nitride powders A, C, and E was 9:18:73 to produce a blend of the boron nitride powders A, C, and E.

100 g of the above-described blend and 1 g of reactive silicone oil (dimethylpolysiloxane with OH groups at both ends, trade name: YF3897, mass average molecular weight: 300,000, manufactured by Momentive Performance Materials Inc.) were put into a rotation and revolution mixer (trade name: Awatorirentaro, model: ARE-310, manufactured by THINKY CORPORATION) and stirred for 3 minutes to perform a surface treatment for the blend. Then, the surface-treated blend was heated at a temperature of 150° C. for 4 hours to produce the boron nitride powder 9.

Heat dissipation sheets were produced using the boron nitride powders 1 to 9 as follows.

[Production of Heat Dissipation Sheet]

65 vol % of the obtained boron nitride powder and 35 vol % of liquid silicone resin (methylvinylpolysiloxane, trade name: CF-3110, manufactured by Dow Toray Co., Ltd.) with respect to a total of 100 vol % of the boron nitride powder and the liquid silicone resin, 1 part by mass of a curing agent (2,5-dimethyl-2,5-bis(t-butylperoxy)hexane, trade name: Rigonox 101, manufactured by KAYAKU NOURYON CORPORATION) with respect to 100 parts by mass of the silicone resin, and 110 parts by mass of toluene with respect to a total of 100 parts by mass of the above-described raw materials were put into a stirrer (trade name: Three-One Motor, manufactured by HEIDON), and mixed for 15 hours using a turbine type stirring blade to prepare a slurry of a thermally conductive resin composition.

Then, the slurry was applied with a thickness of 0.5 mm onto a pet film (a carrier film) having a thickness of 0.05 mm by a doctor blade method and dried at 75° C. for 5 minutes to prepare a sheet-shaped molded body with the pet film. A glass cloth (trade name: H25, manufactured by UNITIKA LTD.) was sandwiched between two sheet-shaped molded bodies with the pet film to prepare a laminate. A layered structure of the laminate was pet film/thermally conductive resin composition/glass cloth/thermally conductive resin composition/pet film. Next, the obtained laminate was hot-pressed under vacuum (pressure: 3.5 kPa) and conditions of a temperature of 155° C. and a pressure of 5 MPa for 30 minutes, and the pet films on both surfaces were peeled off to form a sheet having a thickness of 1.0 mm. Next, the resultant was subjected to secondary heating at 150° C. for 4 hours under a normal pressure to obtain a heat dissipation sheet.

Figure 2:
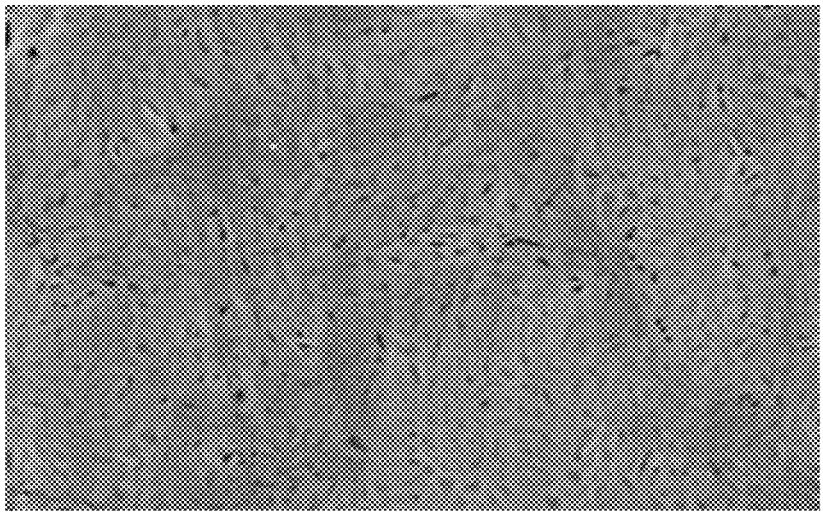
FIG. 2 shows an electron microscope cross-sectional photograph of a heat dissipation sheet produced using a boron nitride powder 1.
Figure 3:
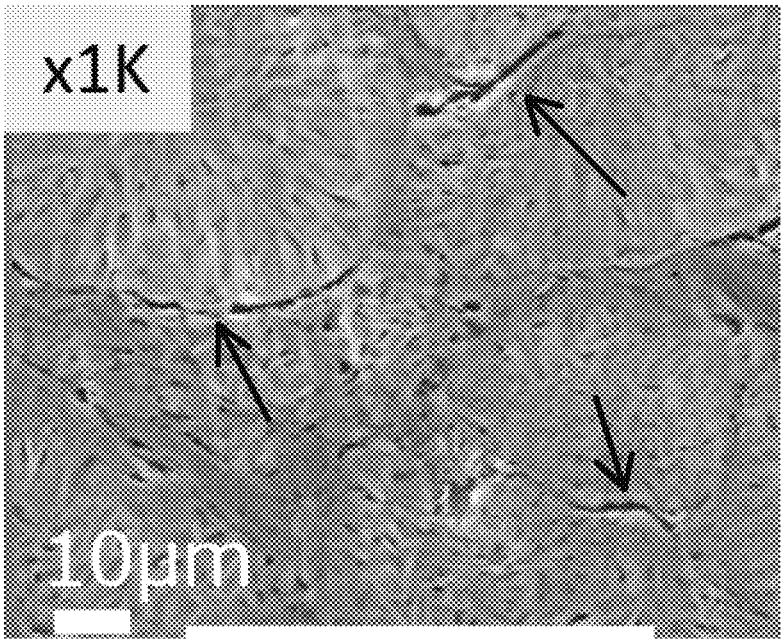
FIG. 3 shows an electron microscope cross-sectional photograph of a heat dissipation sheet produced using a boron nitride powder 7.

The evaluation results are shown in Table 1 below. FIG. 2 shows an electron microscope cross-sectional photograph of a heat dissipation sheet made using the boron nitride powder 1, and FIG. 3 shows an electron microscope cross-sectional photograph of a heat dissipation sheet made using the boron nitride powder 7. As shown in FIG. 2, almost no void was observed in the cross section of the heat dissipation sheet produced using the boron nitride powder 1. As shown in FIG. 3, although voids were present in the cross section of the heat dissipation sheet produced using the boron nitride powder 7 (see arrows), the void area was small.

TABLE 1

| | | | Heat dissipation sheet 1 Example Boron nitride powder 1 | Heat dissipation sheet 2 Example Boron nitride powder 2 | Heat dissipation sheet 3 Example Boron nitride powder 3 | Heat dissipation sheet 4 Example Boron nitride powder 4 | Heat dissipation sheet 5 Example Boron nitride powder 5 |
|---|---|---|---|---|---|---|---|
| Production conditions for boron nitride powder | | Type of surface treatment agent | Reactive silicone oil | Reactive silicone oil | Reactive silicone oil | Reactive silicone oil | Reactive silicone oil |
| | | Mass average molecular weight of surface treatment agent | 10000 | 150000 | 43000 | 43000 | 43000 |
| Evaluation results of boron nitride powder | Infrared absorption spectrum | B—OH peak intensity derived from BN | 0.3 | 0.25 | 0.3 | 0.35 | 0.3 |
| | | Peak intensity derived from reactive silicone | 0.6 | 0.5 | 0.6 | 0.7 | 0.6 |
| | Particle size distribution | First local maximum value (μm) | 7 | 7 | — | 7 | 7 |
| | | Second local maximum value (μm) | 20 | 20 | 20 | 20 | 20 |
| | | Third local maximum value (μm) | 75 | 75 | 75 | 75 | 45 |
| | | Integrated amount (vol %) of first frequency | 9 | 9 | — | 9 | 9 |
| | | Integrated amount (vol %) of second frequency | 18 | 18 | 20 | 18 | 18 |
| | | Integrated amount (vol %) of third frequency | 73 | 73 | 80 | 73 | 73 |

TABLE 1-continued

| | | | | | | |
|---|---|---|---|---|---|---|
| Evaluation results of heat dissipation sheet | Thickness (mm) | 1.0 | 1.0 | 1.0 | 1.0 | 1.0 |
| | Asker C hardness (degree) | 92 | 64 | 87 | 82 | 82 |
| | Dielectric breakdown voltage (kV/mm) | 33 | 27 | 18 | 30 | 30 |
| | Void area rate (%) | 4.2 | 2.9 | 6.5 | 1.6 | 1.6 |
| | Void diameter (μm) | 7.2 | 6.5 | 9.1 | 5.8 | 5.8 |
| | Void shape | Small, minute, circular shape | Extremely small, minute, circular shape | Small, minute, circular shape | Extremely small, minute, circular shape | Extremely small, minute, circular shape |
| | Thermal conductivity (W/mk) | 10.6 | 9.5 | 11 | 10.8 | 10.3 |

| | | | Heat dissipation sheet 6 Example Boron nitride powder 6 | Heat dissipation sheet 7 Example Boron nitride powder 7 | Heat dissipation sheet 8 Comparative Example Boron nitride powder 8 | Heat dissipation sheet 9 Comparative Example Boron nitride powder 9 |
|---|---|---|---|---|---|---|
| Production conditions for boron nitride powder | | Type of surface treatment agent | Reactive silicone oil | Silan coupling agent | — | Reactive silicone oil |
| | | Mass average molecular weight of surface treatment agent | 43000 | 136 | — | 300000 |
| Evaluation results of boron nitride powder | Infrared absorption spectrum | B—OH peak intensity derived from BN | 0.4 | 0.2 | 0.35 | 0.35 |
| | | Peak intensity derived from reactive silicone | 0.6 | — | — | 0.6 |
| | Particle size distribution | First local maximum value (μm) | 5 | 7 | 7 | 7 |
| | | Second local maximum value (μm) | 18 | 20 | 20 | 20 |
| | | Third local maximum value (μm) | 70 | 45 | 75 | 75 |
| | | Integrated amount (vol %) of first frequency | 9 | 9 | 9 | 9 |
| | | Integrated amount (vol %) of second frequency | 18 | 18 | 18 | 18 |
| | | Integrated amount (vol %) of third frequency | 73 | 73 | 73 | 73 |
| Evaluation results of heat dissipation sheet | | Thickness (mm) | 1.0 | 1.0 | 1.0 | 1.0 |
| | | Asker C hardness (degree) | 82 | 91 | 85 | 53 |
| | | Dielectric breakdown voltage (kV/mm) | 30 | 20 | 11 | 8 |
| | | Void area rate (%) | 1.6 | 4.2 | 10.1 | 12.0 |
| | | Void diameter (μm) | 5.8 | 8.7 | 10.1 | 11.0 |
| | | Void shape | Extremely small, minute, circular shape | Small, linear shape (curved shape) along particle interface | large, elliptic shape | large, elliptic shape |
| | | Thermal conductivity (W/mk) | 11.3 | 9.2 | 9.8 | 9 |

From the above evaluation results, it has been found that by using the boron nitride powder surface-treated with the silane coupling agent, a heat dissipation sheet having a surface hardness of 60 degrees to 95 degrees in terms of the Asker C hardness and a dielectric breakdown voltage of 15 kV/mm or more can be produced. However, it has been found that by using the boron nitride powder surface-treated with the reactive silicone oil, a heat dissipation sheet having a surface hardness of 60 degrees to 95 degrees in terms of the Asker C hardness, a dielectric breakdown voltage of 15 kV/mm or more, and even a higher thermal conductivity can be produced.

The invention claimed is:

1. A heat dissipation sheet comprising a boron nitride powder and a resin, wherein a particle size distribution of the boron nitride powder has at least a first local maximum point, a second local maximum point at which a particle size is larger than that at the first local maximum point, and a third local maximum point at which a particle size is larger than that at the second local maximum point, a particle size at the first local maximum point is 0.4 μm or more and less than 10 μm, a particle size at the second local maximum point is 10 μm or more and less than 40 μm, a particle size at the third local maximum point is 40 μm or more and 110 μm or less, and the heat dissipation sheet having a surface hardness of 60 degrees to 95 degrees in terms of an Asker C hardness and a dielectric breakdown voltage of 15 kV/mm or more.

2. The heat dissipation sheet according to claim 1, wherein the heat dissipation sheet has a void area rate of 5.0% or less in a cross section when cut in a thickness direction.

* * * * *